United States Patent [19]

Liu et al.

[11] Patent Number: 4,897,090

[45] Date of Patent: Jan. 30, 1990

[54] PROCESS FOR INHIBITION OF FLYSLAG DEPOSITS

[75] Inventors: Chih-hsiung F. Liu; Charles V. Sternling, both of Houston, Tex.

[73] Assignee: Shell Oil Company, Houston, Tex.

[21] Appl. No.: 373,312

[22] Filed: Jun. 27, 1989

[51] Int. Cl.[4] ..... C10J 3/46

[52] U.S. Cl. ..... 48/210; 48/206; 252/373

[58] Field of Search ..... 48/197 R, 202, 206, 48/210, 203, DIG. 2; 252/373; 122/7 R; 55/80, 83; 165/1

[56] References Cited

U.S. PATENT DOCUMENTS

| | | | |
|---|---|---|---|
| 3,097,081 | 7/1963 | Eastman et al. | 252/373 |
| 4,272,256 | 6/1981 | Mitsak | 48/206 |
| 4,328,008 | 5/1982 | Muenger et al. | 48/197 R |
| 4,436,530 | 3/1984 | Child et al. | 48/197 R |
| 4,482,363 | 11/1984 | Mink | 48/210 |
| 4,823,742 | 4/1989 | Davis et al. | 122/7 R |

*Primary Examiner*—Peter Kratz

*Attorney, Agent, or Firm*—Albert J. Adamcik

[57] ABSTRACT

Fouling or plugging of surfaces in the heat exchange zone following a coal gasification reaction zone caused by deposition of flyslag is inhibited by addition of an amount of graphite to the synthesis gas at a suitable locus or loci.

1 Claim, No Drawings

PROCESS FOR INHIBITION OF FLYSLAG DEPOSITS

BACKGROUND OF THE INVENTION

In one process for the partial combustion or gasification of coal being developed, the coal is reacted at elevated temperatures and elevated pressures with a limited volume of oxygen. The reaction may be carried out in the presence of additional agents such as steam, carbon dioxide, or various other materials. The gasification of coal produces a gas, commonly known as synthesis gas, that contains mostly carbon monoxide and hydrogen. By a combination of factors, such as use of fine particulate dry coal, specially adapted and positioned "burners," e.g., such as described in U.S. patent application 156,675 (Hasenack et al) and U.S. patent application 156,679 (Hasenack et al), both filed Feb. 17, 1988 and incorporated herein by reference, as well as high temperatures and pressures not common in the art, conversion levels of coal are obtainable not previously reported. For example, conversion levels of greater than 98 percent, even 99 percent, basis carbon, may be obtained. Also produced are varying quantities of other gases, such as carbon dioxide and methane, and various liquid and solid materials, such as small particles of ash and carbon commonly known and collectively defined herein as flyslag or flyash. This flyslag, it has been determined, because of the high rate of conversion, does not have the lubricity associated with lower conversion rates, and tends to be different in composition and properties from flyash normally associated with combustion boilers and other processes. In general, the flyslag or flyash entrained with the gas, after solidification, is usually removed from the raw synthesis gas by a combination of cyclones or separators, or a water scrubbing system employing washer coolers, venturi scrubbers, or filters or electrostatic precipitators, or combinations of these systems.

As the flyslag leaves the gasification reactor or zone, it is molten and precaution must be taken to prevent deposition of the sticky particles on the walls of the subsequent stages in the form of strongly adhering layers. For example, a number of patents describe a variety of quenching techniques, such as the use of a cool recycle gas designed to solidify the particles and prevent adhesion, and some patents describe the use of rappers to easily dislodge weakly adhering layers. The invention also addresses this problem.

SUMMARY OF THE INVENTION

Accordingly, in one embodiment, the invention relates to a process for the gasification of coal or similar carbonaceous material comprising (a) oxidizing particulate coal in a gasification zone under conditions to produce synthesis gas at a temperature of from about 1050° C. to about 1800° C., said synthesis gas containing molten flyslag particles;

(b) passing said synthesis gas from said gasification zone to and through a heat exchange zone having walls cooler than the melting point of said flyslag particles, the heat exchange zone comprising a quench section and a heat exchange section in flowthrough communication therewith, and quenching and cooling said synthesis gas and solidifying said flyslag particles in said heat exchange zone; and (c) introducing graphite into said synthesis gas which passes through said heat exchange zone.

As used herein, the term "graphite" includes both natural graphite and any form of partially graphitized carbon, as understood by those skilled in the art, and as described more fully in the *Encyclopedia of Chemical Technology*, 2nd edition, volume 4, pages 183 through 200 and 304 through 311, and the New York State Energy Research and Development Report, 80-5 (April 1980). Forms of graphite in this sense include mineral commercial graphite, chars from coal, wood and oil processes and soots. The amount of graphite added will vary with the coal utilized and depends, among other things, on the deposit formation tendency of the particular coal as well as the degree of lubricity desired in the particles by the process operator. Accordingly, the amount added, i.e., an amount effective to inhibit formation of strongly adhering deposits, will range from minimal amounts to great excess so that sufficient lubricity is achieved. Practically speaking, the amount of graphite added will normally be added in excess, the test of sufficiency being the lack of any additional significant observable benefit. In general, from 1 to 1000 pounds of graphite per million estimated pounds of flyslag in the gas will be sufficient.

According to the invention, the graphite is introduced or added at a suitable locus or loci, preferably at the entrance to the heat exchange zone. The terms "introduced" or "added," as used herein, are taken to require positive inclusion of the graphite in the synthesis gas in the locus or loci specified and are considered to exclude any carbon containing particulate matter, such as flyash, already present in the gas from the gasification zone. The graphite may be added, as indicated, at the entrance to the quench section, or it may be added at the entrance to any succeeding heat exchange section. The graphite may be introduced suitably as particulate graphite, perhaps with other solids, as a suspension in a suitably chosen carrier gas or as a slurry of graphite in a suitable carrier liquid. What is required simply is that solid graphite be introduced into the hot synthesis gas from the reactor in a manner that good contact with the molten or sticky particles occurs. This may be done, for example, by injection into the gas, or by feeding the graphite with a cool recycle gas that may be used to quench the gas stream. The graphite deposits preferentially on the outer surface and provides a lubricity which may inhibit the sticking of the flyslag particles on the walls of the heat exchange zone. An additional advantage of the graphite is that any flyslag recycled that contains the graphite will be more easily transported and has the additional carbon value of the graphite available for recovery.

DETAILED DESCRIPTION OF THE INVENTION

The partial combustion of coal to produce synthesis gas, which is substantially carbon monoxide and hydrogen, and particulate flyslag, is well known, and a survey of known processes is given in *Ullmanns Enzyklopadie Der Technischen Chemie*, volume 10, pages 136 through 458 (1958). Several such processes for the preparation of hydrogen and carbon monoxide, flyslag-containing gases are currently being developed. Accordingly, details of the gasification process are related only insofar as is necessary for understanding of the present invention.

In general, the gasification is carried out by partially combusting the coal with a limited volume of oxygen at a temperature normally between 800° C. to 2000° C. If a temperature of between 1050° C. and 2000° C. is employed, the product gas will contain very small amounts of gaseous side products such as tars, phenols and condensable hydrocarbons, as well as molten flyslag particles and vaporized mineral matter such as salts. Suitable coals include lignite, bituminous coal, sub-bituminous coal, anthracite coal, and brown coal. Lignites and bituminous coals are preferred. In order to achieve a more rapid and complete gasification, initial pulverization of the coal is preferred. Particle size is preferably selected so that 70% of the solid coal feed can pass a 200-mesh sieve. The gasification is preferably carried out in the presence of oxygen and steam, the purity of the oxygen preferably being at least 80% by volume, nitrogen, carbon dioxide, steam and argon being permissible as impurities. If the water content of the coal is too high, the coal should be dried before use. The atmosphere will be maintained reducing by the regulation of the weight ratio of the oxygen to moisture and ash free coal in the range of 0.6 to 1.1, preferably 0.8 to 0.9. The specific details of the equipment and procedures employed form no part of the invention, but those described in U.S. Pat. No. 4,350,103 and U.S. Pat. No. 4,458,607, both incorporated herein by reference, may be employed. Steam may or may not be employed. Accordingly, if present, the ratio between oxygen and steam may be selected so that from 0.05 to 1.0 parts by volume of steam is present per part by volume of oxygen, although the invention is applicable to processes having substantially different ratios of oxygen to steam. The oxygen used is preferably heated before being contacted with the coal, preferably to a temperature of from about 200° C. to 500° C.

The space velocities of the synthesis gas and flyslag particles exiting the reactor or gasification zone may be regulated at the desired levels by techniques familiar to those skilled in the art. For example, if the velocities are too low, gas, e.g., recycle quench gas, may be added at high pressure to increase the rate of flow. If the synthesis gas velocity is too high, the total flows through the reactor may be reduced. In general, superficial space velocities should be from about 6 meters per second to about 12 meters per second.

The details of the gasification reactor system form no part of the present invention, and suitable reactors are described in U.S. Pat. No. 4,202,672 and U.S. Pat. No. 4,022,591. The high temperature at which the gasification is carried out is obtained by reacting the coal with oxygen and steam in a reactor at high velocity. A preferred linear feed injection velocity is from 10 to 100 meters per second, although higher or lower velocities may be employed. The pressure at which the gasification can be effected may vary between wide limits, preferably being from 1 to 200 bar. Residence times may vary widely. Common residence times are from 0.2 to 20 seconds, with residence times of from 0.5 to 15 seconds being preferred.

After the starting materials have been converted, the reaction product, which comprises hydrogen, carbon monoxide, carbon dioxide, and water, as well as the aforementioned impurities, is removed from the reactor. This gas, which normally has a temperature between 1050° C. and 1800° C., contains the impurities mentioned and flyslag, including carbon-containing solids. In order to permit removal of these materials and impurities from the gas, the reaction product stream should be first quenched and cooled. A variety of elaborate techniques have been developed for quenching and cooling the gaseous stream, the techniques in the heat exchange zone in general being characterized by use of a quench gas and a boiler in which steam is generated with the aid of the waste heat. The walls of the quench section, i.e., the external or wall surfaces not in contact with the synthesis gas, and those of the heat exchange section, which follows the quench section and is in communication therewith, are cooled with steam or boiling water, and, as indicated, the wall surfaces in contact with the impure synthesis gas may collect deposits of flyslag.

By way of illustration of the invention, in a commercial sized gasifier of, e.g., 2000 tons/day of coal feed, the flow of the synthesis gas and flyslag is maintained through the quench section and the heat exchange section, and to inhibit deposits therein, graphite is added continuously by means of a pneumatically transported stream of graphite in a carrier gas such as nitrogen to the synthesis gas entering the heat exchange section. The amount of graphite added depends on the estimated flyslag content of the gas, but may, for example, comprise from 4 pounds to 4000 pounds added uniformly over a period of 24 hours. The amount of graphite added may be increased or decreased, depending on the flyslag formation propensity of the coal utilized, which may fluctuate. Alternately, the graphite may be added as a 10 percent by weight aqueous slurry by injection from a spray nozzle into the recycle synthesis gas added to th quench zone. The slurry may contain suitable deflocculating agents. Should any particles of flyslag stick, they may be removed by means, such as rappers.

What is claimed is:

1. A process for the gasification of coal comprising (a) oxidizing particulate coal in a gasification zone under conditions to produce synthesis gas, and producing synthesis gas at a temperature of from about 1050° C. to about 1800° C., said synthesis gas containing molten flyslag particles;

(b) passing said synthesis gas from said gasification zone to and through a heat exchange zone having walls cooler than the melting point of said flyslag particles, the heat exchange zone comprising a quench section and a heat exchange section in flow through communication therewith, and quenching and cooling said synthesis gas and solidifying said flyslag particles in said heat exchange zone;

(c) introducing graphite into said synthesis gas which passes through said heat exchange zone in an amount effective to inhibit formation of strongly adhering deposits; and (d) separating flyslag from the cooled gaseous stream, and recovering synthesis gas from said gaseous stream.

* * * * *